United States Patent [19]

Deminski

[11] Patent Number: 4,661,050

[45] Date of Patent: Apr. 28, 1987

[54] HIGH PRESSURE GAS TRANSMISSION COMPRESSOR

[75] Inventor: Richard M. Deminski, Mt. Vernon, Ohio

[73] Assignee: Anglo Compression, Inc., Mt. Vernon, Ohio

[21] Appl. No.: 177,863

[22] Filed: Aug. 13, 1980

[51] Int. Cl.[4] ..... F04B 39/10

[52] U.S. Cl. ..... 417/454; 417/536; 417/568

[58] Field of Search ..... 417/536, 537, 567, 568, 417/454, 502, 503, 534, 535

[56] References Cited

U.S. PATENT DOCUMENTS

| | | | |
|---|---|---|---|
| 56,218 | 7/1866 | Hartley | 417/536 X |
| 1,170,177 | 2/1916 | Neiswanger | 417/568 X |
| 1,226,693 | 5/1917 | Pocock | 417/537 |
| 1,301,485 | 4/1919 | Mueller | 417/454 X |
| 1,405,737 | 2/1922 | Nelson et al. | 417/537 X |
| 1,507,441 | 9/1924 | Snider | 417/536 |
| 1,719,998 | 7/1929 | Prellwitz | 417/536 |
| 1,946,166 | 2/1934 | Kovach | 417/537 X |
| 2,011,304 | 8/1935 | Sharp | 417/536 |
| 2,055,046 | 9/1936 | Phillips et al. | 417/536 |
| 2,304,992 | 12/1942 | Foster | 417/537 X |
| 2,609,756 | 9/1952 | Wright et al. | 417/454 |
| 2,690,868 | 10/1954 | Gehres | 417/559 |
| 2,792,785 | 5/1957 | Hayden | 417/568 |
| 2,962,975 | 12/1960 | Camp | 417/536 |
| 3,081,934 | 3/1963 | Abernathy et al. | 417/536 |
| 3,181,474 | 5/1965 | Yohpe | 417/568 |
| 3,679,332 | 7/1972 | Yohpe | 417/503 |
| 4,008,012 | 2/1977 | Page | 417/454 |
| 4,195,970 | 4/1980 | Zalis | 417/269 |

*Primary Examiner*—Carlton R. Croyle
*Assistant Examiner*—Paul F. Neils
*Attorney, Agent, or Firm*—Frost & Jacobs

[57] ABSTRACT

A high pressure gas transmission compressor having valve chambers incorporating valves located in common valve pockets where the center lines of the valve chambers are non-intersecting with the compressor cylinder. In a first embodiment, the valve housings are vertically positioned at each end of the cylinder such that the valve chambers are parallel to each other and perpendicular to the cylinder with the ends of the chambers extending on either side of the cylinder. Each valve chamber contains discharge and suction valves, with the outlets of the discharge valves being joined to the discharge port of the compressor by a semi-cylinder like annular discharge cavity spaced from and partially surrounding a portion of the cylinder. The inlets of the suction valves are joined to the suction port by a similar semi-cylinder like annular cavity. In other embodiments, the compressor includes four valve housings spaced about 90° apart and positioned such that the valve chambers are substantially parallel to the cylinder. In one embodiment, the valve chambers include mixed suction and discharge valves. In another embodiment, each valve chamber contains only suction or discharge valves. The discharge and suction valves are connected as a unit or as sub assemblies to permit their withdrawal through one end of the valve chamber to facilitate repair or replacement.

7 Claims, 16 Drawing Figures

HIGH PRESSURE GAS TRANSMISSION COMPRESSOR

SUMMARY OF THE INVENTION

The present invention relates generally to double-acting high pressure gas transmission compressors, and more particularly to a compressor having vertically or horizontally oriented valve chambers incorporating valves located in common valve pockets.

Conventional compressors, particularly those used for transmitting natural gas and other compressible fluids through pipe lines, generally make use of a horizontally reciprocating double-acting piston driven by any one of a number of prime movers, such as an internal combustion engine, for example. During the intake or suction stroke, gas is drawn into the compressor cylinder from the suction port, generally located at the top of the compressor, through poppet or plate valves positioned in a pair of valve chambers oriented radially with respect to the compressor cylinder. Similarly, during the exhaust stroke, gas at a higher pressure is discharged from the compressor exhaust port through a valving arrangement made up of poppet or plate valves positioned in valve chambers also oriented radially with respect to the compressor cylinder such that the centerlines of the valve chambers and cylinder intersect.

Compressors of this general type utilizing radially disposed valving configurations are widely used, and have gained widespread acceptance. Nonetheless, certain features have been noted as undesirable in particular applications. For example, from time-to-time the valves which control suction or discharge in the compressor become worn or damaged and must be replaced or repaired. For valves located in the upper valve chambers, this may be accomlished by removing the upper valve chamber end cap and lifting the upper valve assembly clear of the valve chamber by an overhead hoist. However, since the valve chambers extend upwardly and outwardly from the compressor housing, the valve assembly must also be supported from the side to prevent binding or damage to the valve assembly as it is being withdrawn. This often necessitates special tools and support fixtures as well as the concerted efforts of several workmen. The procedure may be further complicated in installations where several compressors are placed in close proximity side-by-side.

Replacement or repair of components located within the lower radially disposed valve chambers may also be necessary. In this situation the lower valve chamber end caps are located close to floor level. Consequently, the valve assembly cannot usually be removed merely by removing the lower end cap and dropping the valve assembly through the valve chamber opening. The valve assembly, which itself may have considerable weight, must be dropped downwardly at an angle, also necessitating the use of special tools and holding fixtures, as well as involving risk of equipment damage or personal injury.

As is well known, gas compressors associated with transmission lines are often operated in parallel to increase the flow volume or pressure of the gas. It has been found convenient to locate two or more compressors close together on a given engine to minimize interconnecting piping and floor space. However, due to the radially disposed valve chambers or pockets, conventional compressors of this type cannot be placed side-by-side without interference between adjacent valve pockets and the associated unloader structures. Consequently, conventional compressor designs impose undesirable limitations in many cases.

Another drawback to conventional high pressure gas compressors employing radially disposed valve chambers is the requirement of a separate valve chamber or pocket for each valve. In other words, each intake or suction valve, whether of the poppet or plate variety, requires a separate operating chamber with interconnecting passageways leading to a common suction port. Likewise, each exhaust valve also requires a separate operating chamber with associated passageways connected to a common exhaust port. This construction not only requires considerably more machining, but results in the removal of compressor housing material in the areas of greatest stress, thereby weakening the overall structure. To compensate for this loss of structural integrity, additional material must be provided for the compressor housing, significantly increasing the size, cost and weight of the unit.

The improved high pressure gas compressor of the present invention seeks to overcome these and other disadvantages of prior gas compressors using radially disposed valve arrangements. Fundamentally, in the present invention the centerlines of the valve and valve chambers are non-intersecting with the centerline of the cylinder. Furthermore the valves in a given chamber are removable through single openings located at one end of the chamber. In a first embodiment, the compressor includes a compressor housing having a horizontal elongated smooth bore cylindrical cylinder extending longitudinally through the compressor housing or body. A cylindrical multi-part piston is slidably received for reciprocating movement within the cylinder under control of a prime mover such as an internal combustion engine or the like. As is well known, sealing means in the form of a pair of spaced annular piston rings provide a gas tight sliding seal with the cylinder walls. A pair of generally rectangular spaced openings extend through the side walls of the cylinder beyond the limits of travel of the piston rings at each end of the compressor during reciprocating movement of the piston. As will become apparent, not only is the cylinder liner construction greatly simplified, but the strength of the compressor housing or body is significantly increased since fewer port openings or cutouts are necessary. Furthermore, piston ring overtravel of the valve ports is specifically avoided, thereby reducing piston ring wear. The port location is specifically advantageous when rider rings are used.

Each end of the compressor housing is supplied with a pair of vertically oriented hollow valve housings spaced on either side of the cylinder bore adjacent each end thereof and extending above and below the cylinder bore. The valve chambers formed within the valve housings are parallel to each other and perpendicular to the cylinder axis, with each chamber including a centrally positioned gas passageway extending horizontally between the valve chamber and the adjacent cylinder opening. The external appearance of the resulting compressor with non-intersecting valve and cylinder centerlines consequently resembles a four-poster bed, rather than the characteristic X-shape of conventional compressors having four radially disposed valve housings and chambers where the centerlines of each intersect.

A valve assembly, which may be provided as a unit or subassembly, is positioned within each of the valve chambers. Each valve chamber includes a suction and discharge valve positioned within each of the valve chambers on either side, respectively, of the valve chamber openings. As will be explained in more detail hereinafter, these valves may be of the single or ported plate valve variety, or may comprise poppet valves of the type described in my copending application Ser. No. 866,033, filed Dec. 30, 1977, entitled SEAT GUIDED POPPET VALVE HAVING FLOW AND DAMPENING CONTROL MEANS and assigned to the same assignee. The suction valves are positioned in the upper portion of the valve chambers and operate to permit intake of low pressure gas during the suction stroke of the piston, while the discharge valves are positioned in the lower portion of the valve chambers and operate to permit discharge of high pressure gas during the exhaust or compression stroke of the piston. This valve orientation permits the use of larger suction and discharge flange connections than is possible with compressors using conventional radially disposed valves. Furthermore, a smaller number of closely positioned larger valves may be utilized, improving performance at less cost.

Means in the form of a semi-cylindrical like annular discharge cavity spaced from and partially surrounding the lower portion of the cylinder bore connects the outlet ends of the discharge valves to form the exhaust port or discharge outlet of the compressor. Similar means in the form of a semi-cylindrical like annular suction cavity spaced from and partially surrounding the upper portion of the cylinder bore connects the inlet ends of the suction valves to form the suction port of the compressor. As will become apparent, the use of a single common connecting passageway for feeding discharge and suction valves eliminates the multiplicity of interconnecting passageways common in compressors using radially disposed valves, significantly increasing the strength of the compressor structure.

It will be observed that this construction permits the suction and discharge valves to be located within a common valve chamber or pocket, thereby minimizing the amount of machining and additional material which must be removed from the compressor housing casting. Consequently, half the number of valve pockets required by a compressor having radially disposed valve chambers is necessary. Furthermore, the valve assemblies may be constructed as a single unit positioned within the vertically oriented valve chambers. Consequently, in one embodiment, the valve assembly may be removed quickly and easily as an entire unit in a single vertical motion through the upper end of the valve housing. Since access to the valve chamber through the lower end is no longer necessary, the lower ends of the valve housings may be located as close to floor level as is desired, and the overall length of the compressor may be shortened. Furthermore, since the valve housings themselves do not extend horizontally significantly beyond the compressor housing, individual compressor units may be placed closely side-by-side thereby minimizing floor space and interconnecting conduits, as well as avoiding interference with headers or valve chambers of adjacent compressors.

It will be further observed that the unique design of the present invention reduces pulsation problems by the shorter distances between valves and the respective nozzles or flange locations.

A second embodiment of the present invention is constructed similarly to that described hereinabove except that the hollow valve housings are arranged longitudinally on the outer surface of the compressor housing such that the valve chambers formed within the housings are positioned 90° apart and their axes extend parallel to the cylinder bore. Each chamber includes a gas passageway at both ends which communicate with the cylinder bore interior through cooperating spaced openings extending through the side walls of the cylinder beyond the limits of travel of the piston rings during reciprocating movement of the piston. A valve assembly removable as an entire unit may be positioned within each of the longitudinally extending valve chambers. Each assembly includes a pair of suction and discharge valves positioned within each of the valve chambers on either side, respectively, of the valve chamber openings. The discharge valves are positioned at the end extremes of the valve chambers and operate to permit discharge of high pressure gas during the exhaust or compression stroke of the piston, while the suction valves are positioned inwardly of the discharge valves and operate to permit intake of low pressure gas during the suction stroke of the piston.

Means in the form of a cylinder-like annular discharge cavity spaced from and surrounding the cylinder bore connects the outlet ends of the discharge valves to form the exhaust port or discharge outlet of the compressor. Similar means in the form of a semi-cylindrical like annular suction cavity concentric with the discharge cavity and cylinder bore connects the inlet ends of the suction valves to form the suction port of the compressor.

In another embodiment similar to the second embodiment described hereinabove, each longitudinally extending valve chamber contains only suction or discharge valves. The valve chambers containing only suction valves are placed side-by-side and interconnected by a semi-cylindrical discharge cavity surrounding one-half of the cylinder bore. The compressor discharge port is connected at approximately the midpoint of this cavity. Likewise, the valve chambers containing the discharge valves are placed side-by-side and interconnected by a semi-cylindrical suction cavity surrounding the opposite half of the valve chamber, which joins with the suction port of the compressor.

It will be observed that these arrangements minimize the vertical height of the compressor, and further facilitate side-by-side operation of cooperating compressor units. Furthermore, the valve assemblies may be removed in a horizontal direction, thereby eliminating the need for an overhead crane or hoist. Other features of the invention will become apparent from the detailed description which follows.

BRIEF DESCRIPTION OF THE DRAWING

FIG. 6 is a partial cross-sectional view taken along section line 6—6 of FIG. 2.

FIG. 13 is a diagrammatic front perspective partially cross-sectional view of a third embodiment of the compressor of the present invention utilizing longitudinally oriented valve chambers having segregated suction and discharge valving.

DETAILED DESCRIPTION

A first embodiment of the improved high pressure gas transmission compressor is illustrated generally at 1 in FIG. 1–FIG. 6. Compressor 1 includes a generally blocklike housing 2 which may be fabricated as a casting from cast iron, cast steel, aluminum, or the like. Housing 2 is provided with a substantially horizontally extending elongated smooth bore cylindrical cylinder 3 which extends longitudinally through the housing. Cylinder 3 may also be provided with a smooth bore cylindrical removable wear sleeve or liner 4 of high quality bearing or wear resistant material as is well known in the art.

Figure 1:
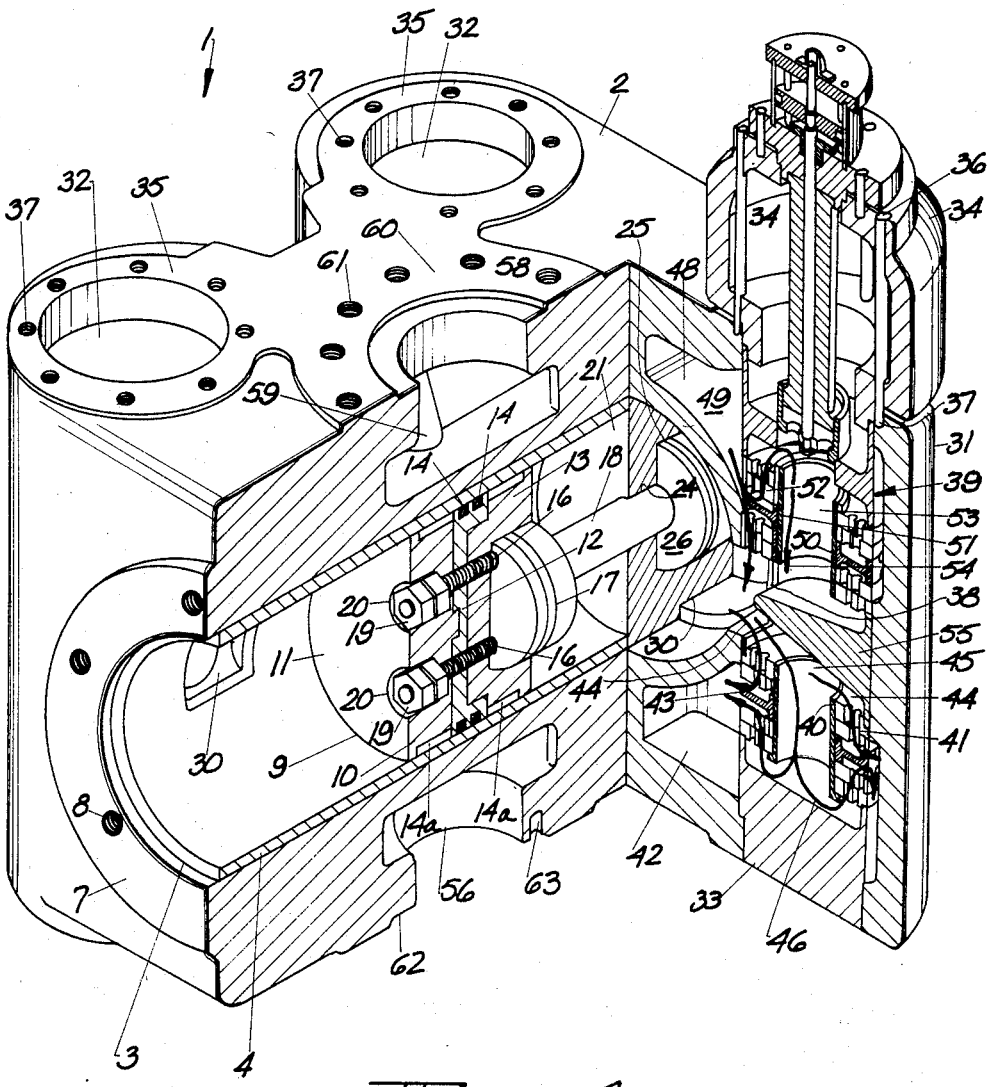
FIG. 1 is a front partially cut-away perspective view of a first embodiment of the high pressure gas compressor of the present invention with two of the upper valve housing end caps and one cylinder end cap removed for clarity.
Figure 2:
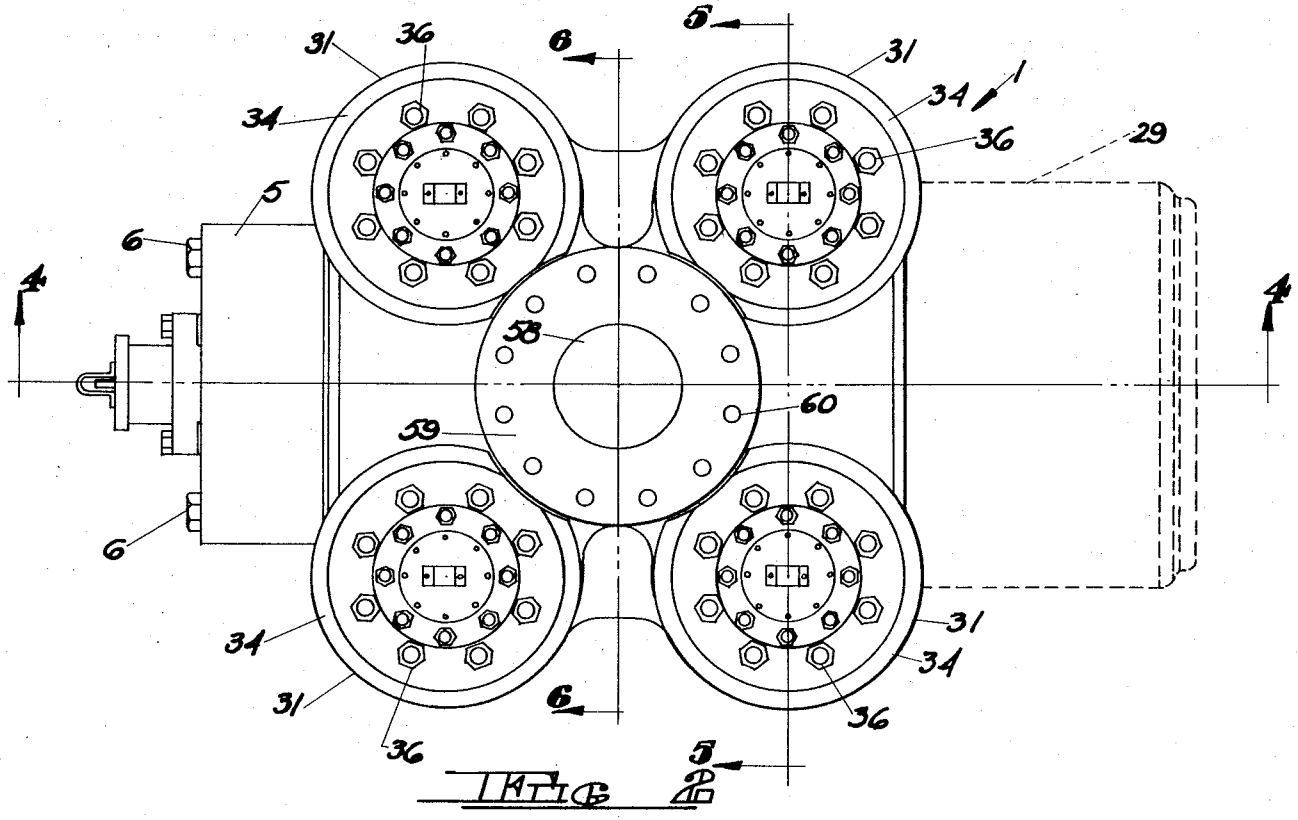
FIG. 2 is a top plan view of the high pressure gas compressor of FIG. 1.
Figure 3:
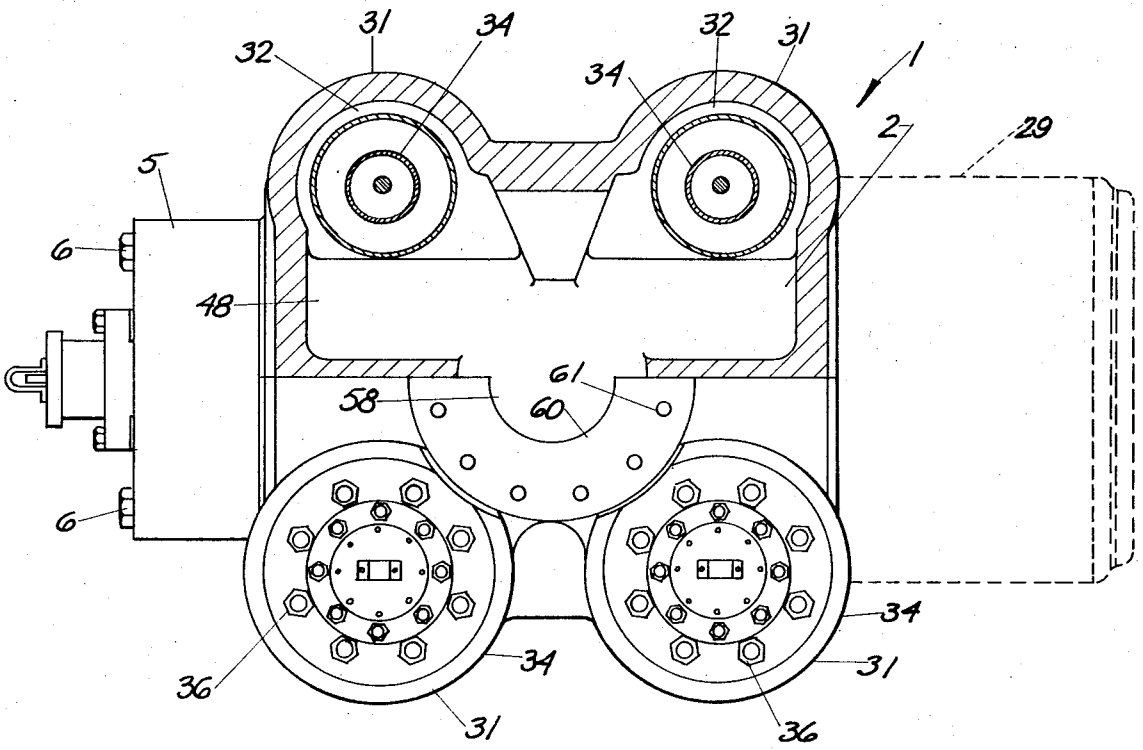
FIG. 3 is a partially cross-sectional top plan view of the high pressure gas compressor of FIG. 1.

One end (see FIG. 4) of cylinder 3 may be closed by means of a cylinder end cap 5 including the unloader structure **5*a* secured to one end of housing 2 by means of threaded bolts or the like 6. As illustrated in FIG. 1, end cap 5 has been removed for clarity to illustrate the end cap mounting surface 7 on housing 2 and associated threaded bolt holes 8. It will be observed that end cap 5 may be easily removed to gain access to cylinder 3 to replace or repair wear sleeve 4** or other internal components.

A generally cylindrical multiple part double acting piston 9 is slidingly received for reciprocating movement within liner 4. Piston 9 comprises a cylindrical platelike front member 10 having a front working face 11, a central plate-like member 12 and a rear plate-like member 13 having a rear working face **11*a*. The peripheral edges of the piston members 10, 12 and 13 provide a sliding seal with the inner wall surfaces of liner 4. Central member 12 is provided with a pair of spaced annular piston rings 14 secured within circumferential grooves 15 to provide an additional sliding seal between piston 9 and the inner wall of the cylinder sleeve as is well known in the art. Furthermore, rider rings 14*a* may also be used where required. A plurality of studs 16 threadedly engage the flanged end 17 of piston rod 18, and pass through coaxial apertures in piston members 10, 12 and 13, respectively. The outermost ends of threaded studs 16 terminate in a pair of lock nuts 19 seated in counterbores 20 to securely hold the entire assembly tightly together. It will be observed that the outermost surfaces of lock nuts 19 are flush with or recessed slightly below the working face 11 of piston 9**.

The opposite end of cylinder 3 is closed by means of a cylinder end cap 21 having an annular shoulder 22 which rests against a cooperating annular shoulder on the inner wall of cylinder 3. It will be observed that this arrangement permits liner 4, end cap 21, piston 9 and packing 27 to be removed from the left end of the cylinder as viewed in FIG. 4. Suitable seals such as O-rings and the like 23 positioned in cooperating circumferential grooves may be provided as required to insure a fluid-tight seal between end cap 21 and the cylinder bore.

End cap 21 is also provided with a central bore 24 adapted to slidingly receive the free end of piston rod 18. A second bore 25 coaxial with bore 24 receives a plurality of stacked annular packing glands 26 which are configured to provide a sliding seal with the outer surface of piston rod 18 as is well known in the art. Packing glands 26 are held in place by means of a flange nut 27 which is held in place to end cap 21 by means of connecting bolts 28. The free end of piston rod 18 may be connected to an appropriate reciprocating drive, illustrated diagrammatically at 29, such as an internal combustion engine or the like, as is well understood in the art, to cause piston 9 to reciprocate between positions adjacent the inner surfaces of cylinder end caps 5 and 21, respectively. As will become apparent from the detailed description which follows, gas will be compressed in the portion of liner 4 between end cap 5 and piston working face 11 when piston 9 is adjacent the inner surface of end cap 5, while at the same time low pressure gas will be drawn into the portion of liner 4 between end cap 21 and piston working face **11*a* from the suction port. Conversely, gas will be compressed in the portion of liner 4 between end cap 21 and piston working face 11*a* when piston 9 is moved toward end cap 21, while at the same time low pressure gas will be drawn into the portion of liner 4 between end cap 5 and piston working face 11**.

Figure 4:
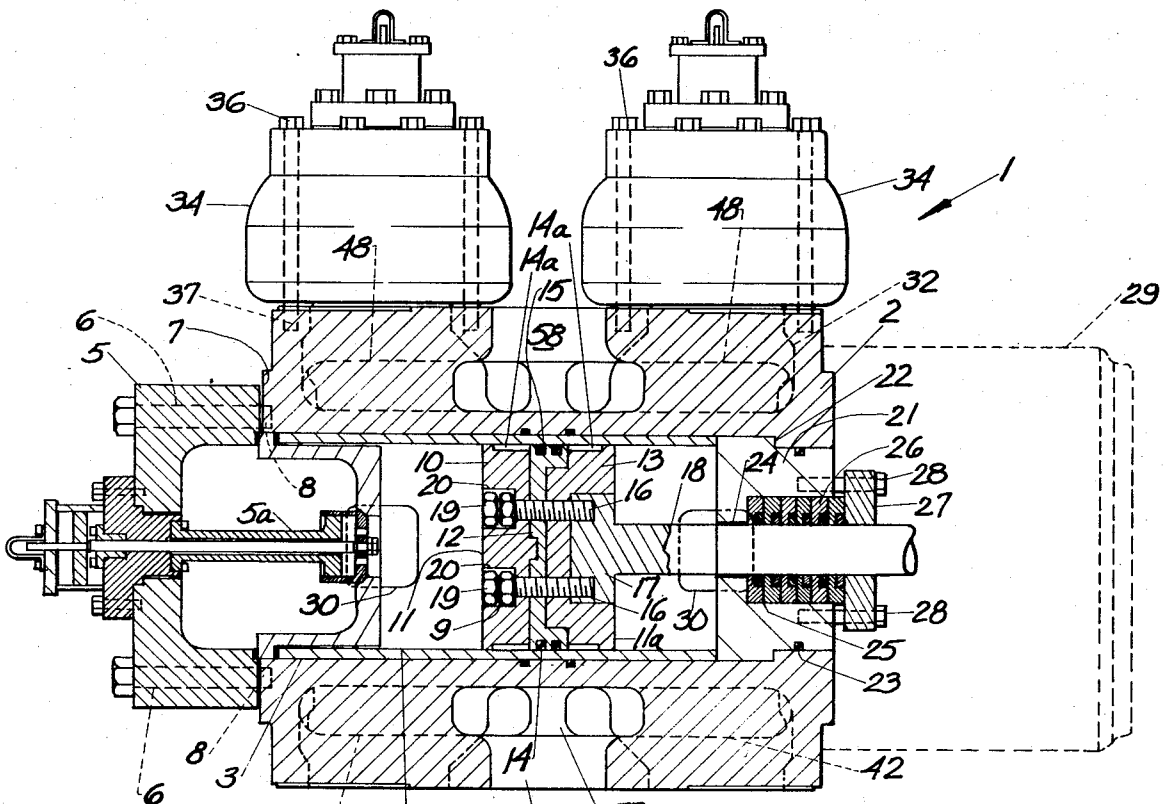
FIG. 4 is a cross-sectional view taken along section line 4—4 of FIG. 2.

Each of the side walls of cylinder 3 is provided with a pair of spaced, generally rectangular openings 30 extending through liner 4 beyond the limits of travel of piston rings 14 during reciprocating movement of piston 9. As best shown in FIG. 4, cylinder wall openings 30 are positioned at approximately the mid-line of the cylinder side walls. As will be explained in more detail hereinafter, openings 30 permit the fluid to enter and leave cylinder 3 under control of double-acting piston 9.

Each end of the compressor housing 2 is supplied with a pair of vertically oriented hollow valve housings 31 spaced on either side of the cylinder bore 3 adjacent each end thereof and extending above and below the cylinder bore. Each valve housing 31 contains a generally cylindrical valve chamber 32. It will be observed that valve chambers 32 are parallel to each other and perpendicular to cylinder 3. Furthermore, it is important to note that an important characteristic which distinguishes the present invention from conventional compressor arrangements is the fact that the centerlines of the cylinder 3 and valve chambers 32 containing the valve structures are non-intersecting. As noted above, this construction simplifies the manufacture, installation and maintenance of compressor 1. Consequently, the overall appearance of compressor 1 resembles that of a four poster bed.

Figure 5:
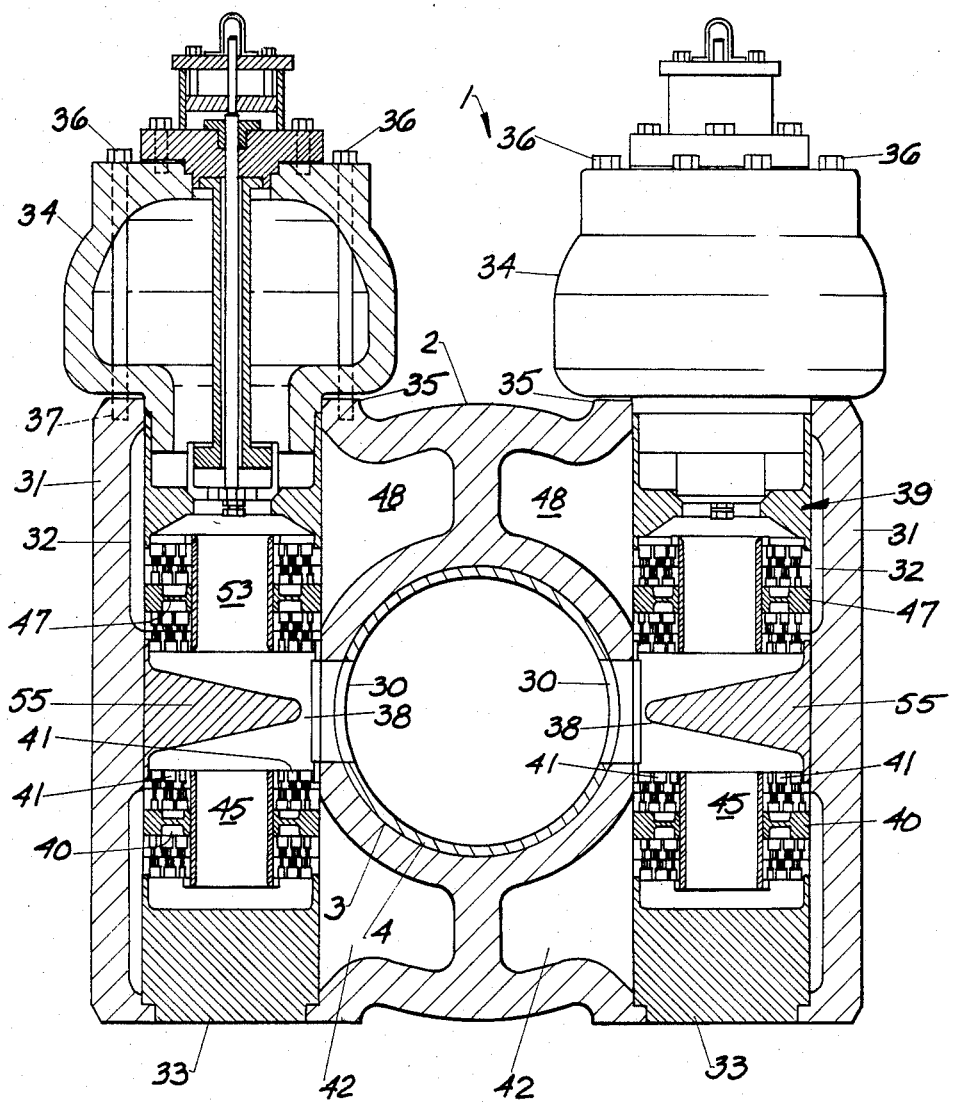
FIG. 5 is a partial cross-sectional view taken along section line 5—5 of FIG. 2 with piston 9 removed for clarity.
Figure 8:
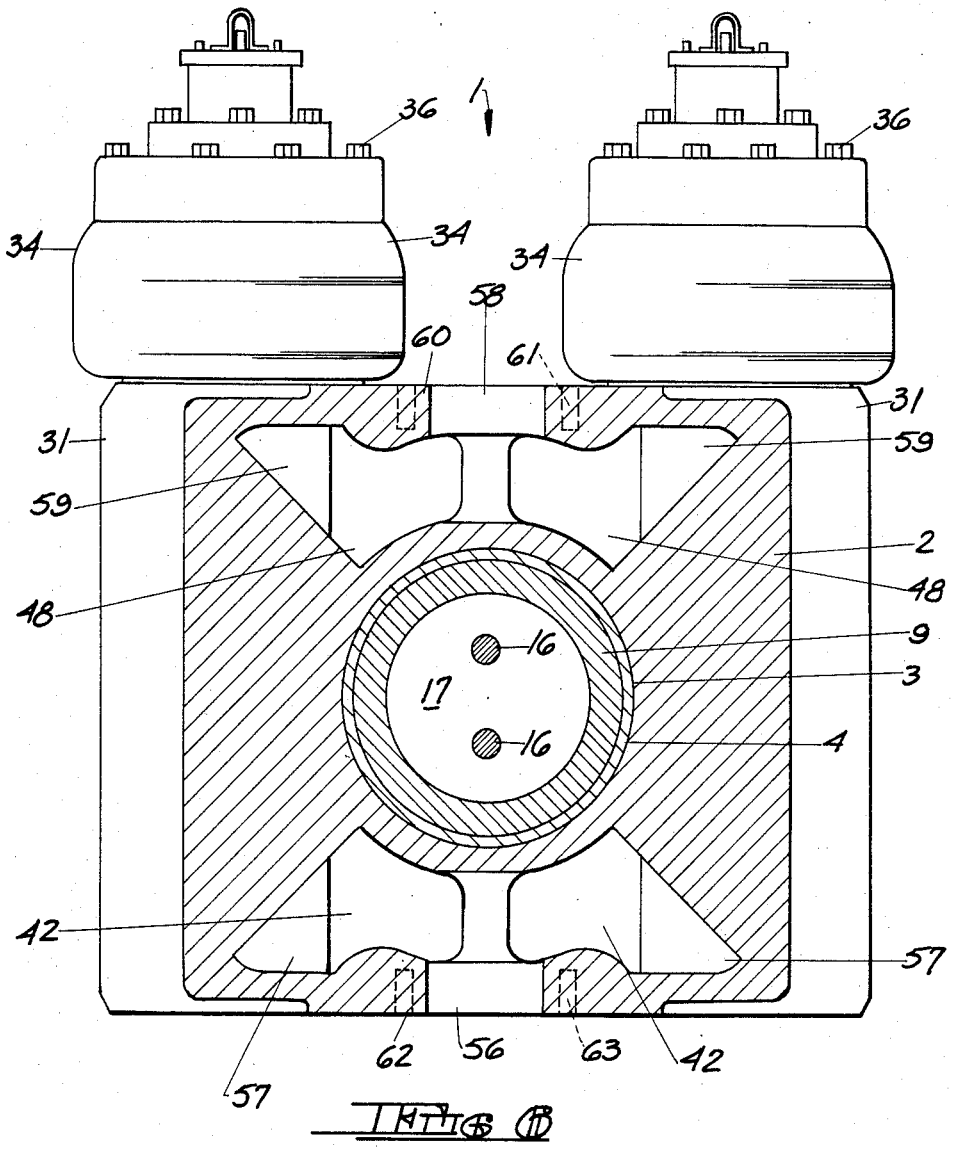
FIG. 8 is a partially cutaway diagrammatic front perspective view of the compressor of FIG. 7 with the piston and cylinder end caps removed for clarity.

As best shown in FIG. 5, the lower end of each valve chamber 32 is closed by means of a lower valve chamber end cap 33 which will generally be non-removably secured within the valve chamber thereby eliminating securing bolts. However, it will be understood that lower end cap 33 may be made removable if desired in installations where it is feasible and desirable to gain entry to the lower end of the valve chamber.

The upper end of each valve chamber 32 is closed by means of a hollow upper valve chamber end cap 34 including the valve unloader structure 34*a* removably secured to mounting surface 35 of compressor housing 2 by means of a plurality of connecting bolts 36 cooperating with threaded holes 37 (see FIG. 1). Alternatively, a simple bolt-on plate or valve cap may be used when unloader structure is not required. It will be observed that this construction permits the easy removal of upper valve chamber end cap 34 thereby permitting access to the upper end of each valve chamber for removal of the valve assembly contained therein as will be explained in more detail hereinafter.

As best shown in FIG. 1 and FIG. 5, each valve chamber 32 includes a centrally positioned gas passageway 38 extending substantially horizontally between the valve chamber and the adjacent opening 30 extending through the walls of cylinder 3 and wear sleeve 4. These gas passageways permit communication of the working fluid between the cylinder 3 and the valve chambers.

Postioned within each valve chamber 32 is a valve assembly, shown generally at 39, which may be removable as an entire unit upwardly through the upper end of the valve chamber when upper valve chamber end cap 34 is removed.

As illustrated, valve assembly unit 39 includes discharge valve means in the form of a discharge valve 40 positioned below gas passageway 38 in the lower portion of valve chamber 32, the discharge valves operating to permit flow from passageways 38 but prevent flow in the opposite direction. In the specific embodiment illustrated, discharge valve 40 comprises a double-deck plate valve manufactured by the assignee of the present invention. In this type of valve, gas flow proceeds from gas passageway 38 downwardly through valve members 41 and into discharge cavity 42 through annular valve opening 43 as indicated by directional arrows 44, and downwardly through central opening 45 and into discharge cavity 42 through opening 43 as indicated by directional arrows 46. While discharge valve 40 has been described and illustrated as a double-deck plate valve, it will be understood that other types of valves such as single or deck and one half plate valves or poppet valves such as that described hereinabove in my copending patent application, may be used as required to permit flow from passageway 38, to discharge cavity 42, but prevent flow in the opposite direction.

In a similar manner, suction valve means in the form of a suction valve 47 is positioned in the upper portion of each valve chamber 32 and operates to permit flow to gas passageway 38 but prevents flow in the opposite direction. As illustrated, suction valve 47 comprises a double-deck plate valve wherein gas flow proceeds from suction cavity 48 through the annular central opening 49 and valve members 50 to gas passageway 38 as illustrated by directional arrows 51, and through a parallel flow path upwardly from opening 49 through valve members 52 and downwardly through central opening 53 to gas passageway 38 as depicted by directional arrow 54. As explained hereinabove, suction valve 47 may also comprise a single deck or deck-and-one-half plate valve, or a poppet valve such as that described in my copending patent application. In any event, suction valve 47 operates to permit gas flow from suction cavity 48 to gas passageway 38, but prevent flow in the opposite direction.

In the preferred embodiment illustrated, each valve chamber 32 also includes a centrally located wedge-shaped baffle 55 positioned between discharge valve 40 and suction valve 47 at approximately the mid-line of gas passageways 38 to direct and channel the gas flow to the appropriate valve. Baffle 55 forms a part of valve assembly unit 39, together with discharge valve 40 and suction valve 47, and will consequently be removed with these other components when valve assembly 39 is withdrawn from valve chamber 32.

It will be observed that discharge cavity 42 comprises means in the form of a semi-cylinder like annular passageway or chamber spaced from and partially surrounding the lower portion of the cylinder bore 3. Discharge cavity 42 connects the annular outlet opening ends 43 of discharge valves 40 to form the exhaust port or discharge outlet 56 of compressor 1. Discharge cavity 42 extends longitudinally a distance at least as great as the distance between longitudinally spaced cylinder wall openings 30. Discharge cavity 42 may also be supplied with radially extending spaced ribs 57 formed as part of the compressor housing to increase the structural integrity of the unit.

Similarly, suction cavity 48 comprises means in the form of a semi-cylinder like annular passageway or chamber spaced from and partially surrounding the upper portion of cylinder bore 3. Suction cavity 48 connects the central inlet end openings 49 of suction valves 47 to form suction port 58 located on the upper end of housing 2 of compressor 1. It will be observed that suction cavity 48 also extends longitudinally a distance at least as great as the distance between longitudinally spaced cylinder openings 30. Suction cavity 48 may also be provided with a plurality of radially extending spaced ribs 59 to provide support for the housing shell overlying the suction cavity.

The upper portion of housing 2 surrounding suction port 58 is supplied with a smooth flat mounting surface 60 having a plurality of circumferentially arranged bolt holes 61 for mounting a gas transmission inlet line (not shown) to compressor 1. Similarly, the lower surface of housing 2 surrounding discharge port 56 may be provided with a similar mounting surface 62 as well as a plurality of circumferentially arranged threaded mounting bolt holes 63 for mounting a suitable gas transmission discharge line (not shown) to compressor 1. It will be understood, however, that compressor 1 may be inverted to provide for bottom suction and top discharge, if desired.

It will also be observed that this construction permits discharge valves 40 and suction valves 47 to be located within a common pocket or valve chamber 32 thereby minimizing the amount of machining and additional material which must be removed from the compressor housing casting. Since the valve assemblies 39 may also be constructed as an integral unit positioned within the vertically oriented valve chambers 32, the entire assembly may be removed quickly and easily in a single vertical motion through the upper end of the valve housing 31. In addition, since access to valve chambers 32 through the lower end 33 is no longer necessary, the lower ends of the valve housings may be located as close to floor level as is desired. Finally, since valve housings 31 do not extend significantly beyond the outline of compressor housing 2, individual compressor units may be placed closely side-by-side, thereby minimizing floor space and interconnecting conduits.

A second embodiment of the high pressure gas transmission compressor of the present invention is illustrated diagrammatically generally at 100 in FIG. 7–FIG. 12. In FIGS. 9–12 the entire compressor cross section is illustrated based on the partial cross sectional view of FIG. 7 and FIG. 8. The primary difference between compressor 100 and compressor 1 illustrated hereinabove in connection with the embodiment of FIG. 1–FIG. 6 is that the valve housings are longitudinally positioned on the outer surface of the compressor housing such that the valve chambers formed within the housings are positioned 90° apart and extend substantially parallel to the cylinder bore. Consequently, like compressor 1, the centerlines of the cylinder and valve chambers of compressor 100 are non-intersecting.

In the particular construction illustrated where elements similar to those described hereinabove have been similarly designated, compressor 100 includes a generally block-like compressor housing 102 provided with a substantially horizontally extending elongated smooth bore cylinder 103 which extends longitudinally within the housing. Cylinder 103 may also be provided with a smooth bore cylindrical removable wear sleeve or liner of material similar to liner 4 described hereinabove. In addition, the ends of cylinder bore 103 may be closed by means of cylinder end caps 105 and 121, similar to cylinder end caps 5 and 21 described hereinabove.

A generally cylindrical double-acting piston 109, which may be of the multiple part type, is slidingly received for reciprocating movement within cylinder bore 103. The outer surface of piston 109 provides a sliding seal with the inner wall surfaces of cylinder 103, and piston 109 may further be provided with one or more annular piston rings similar to piston rings 14. A generally, cylindrical piston rod 118 is attached to one end of piston 109, and may be reciprocated by any suitable reciprocating drive, such as reciprocating drive 29 described hereinabove.

Cylinder end cap 121 is also provided with a central bore 124 adapted to slidingly receive the free end of piston rod 118. Additional sealing may also be provided by one or more annular packing glands (not shown) configured to provide a sliding seal with the outer surface of piston rod 118 as is well known in the art.

Figures 7, 8:
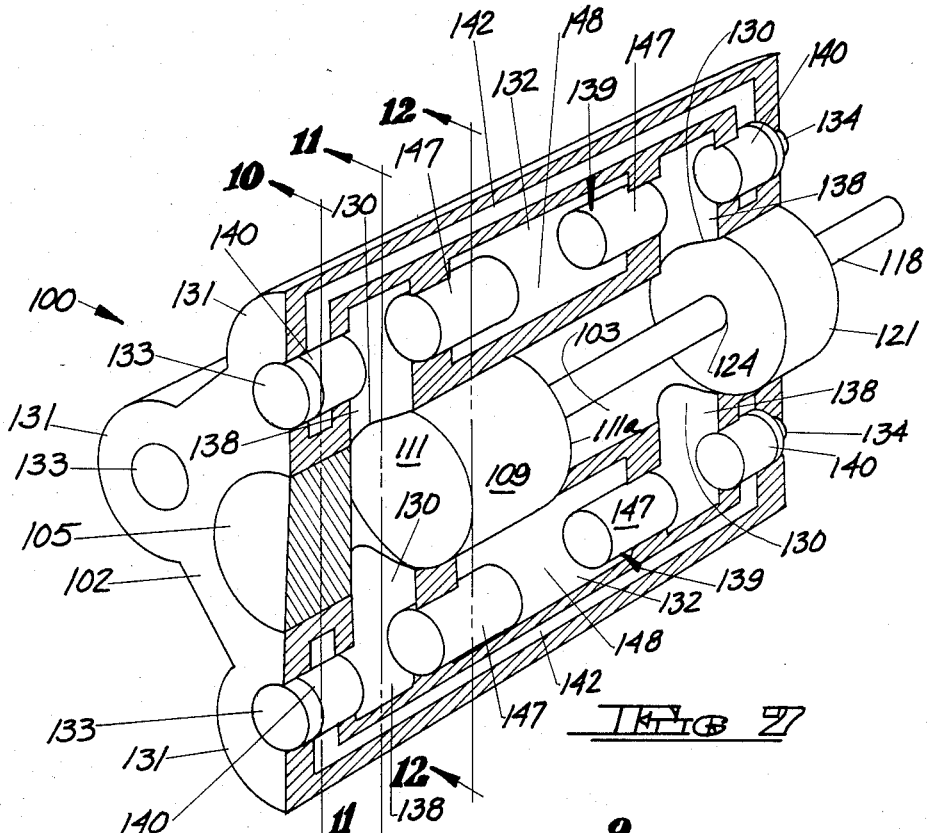
FIG. 7 is a partially cross-sectional diagrammatic front perspective view of a second embodiment of the high pressure gas transmission compressor of the present invention utilizing longitudinally oriented valve chambers having mixed suction and discharge valving.
Figure 9:
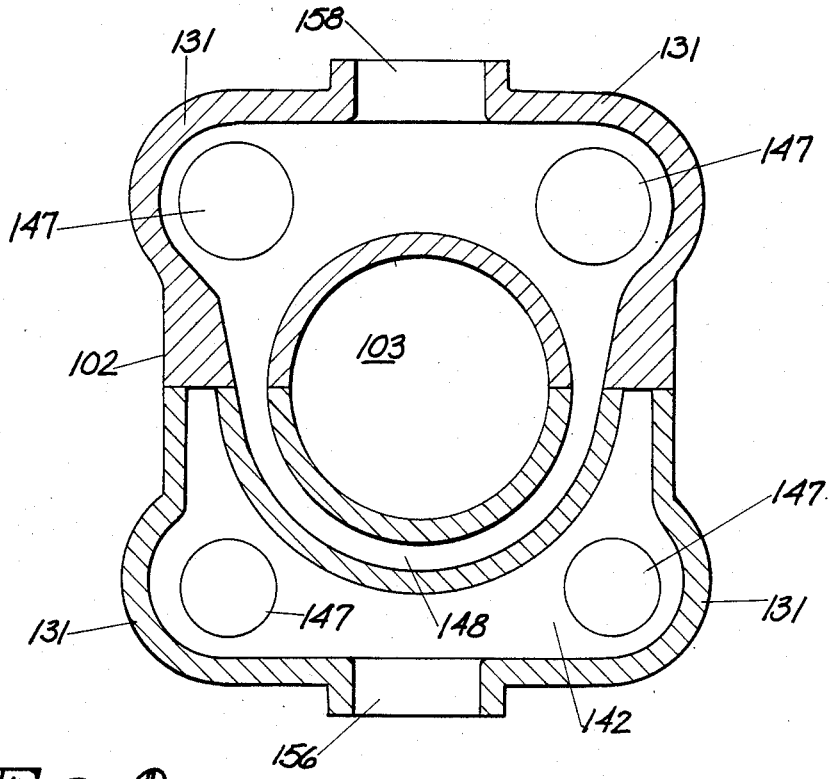
FIG. 9 is a diagrammatic cross-sectional view taken along section line 9—9 of FIG. 8, illustrating the entire compressor.
Figure 10:
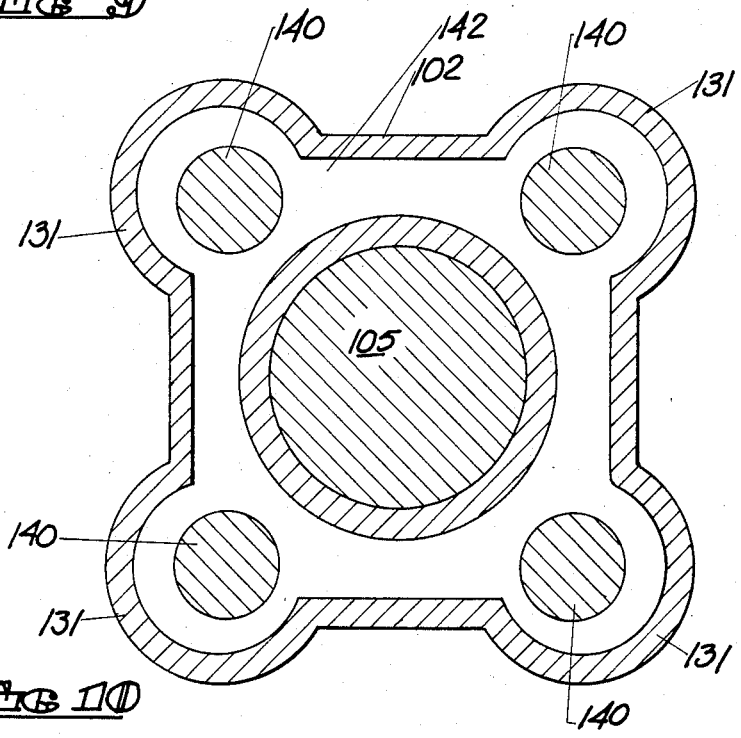
FIG. 10 is a diagrammatic cross-sectional view taken along section line 10—10 of FIG. 7, rotated 45°, illustrating the entire compressor.
Figure 11:
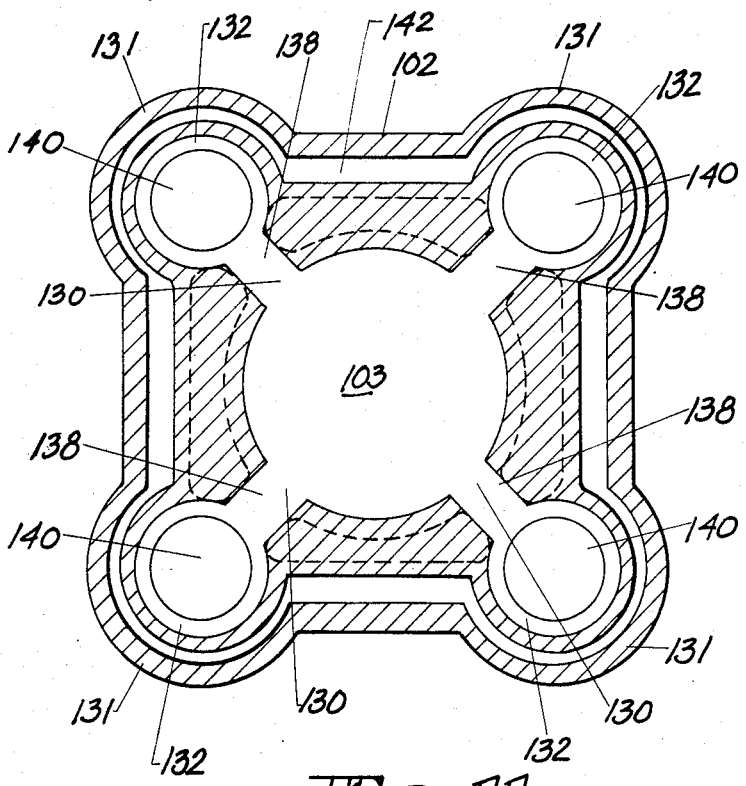
FIG. 11 is a diagrammatic cross-sectional view taken along section line 11—11 of FIG. 7, rotated 45°, illustrating the entire compressor.
Figure 12:
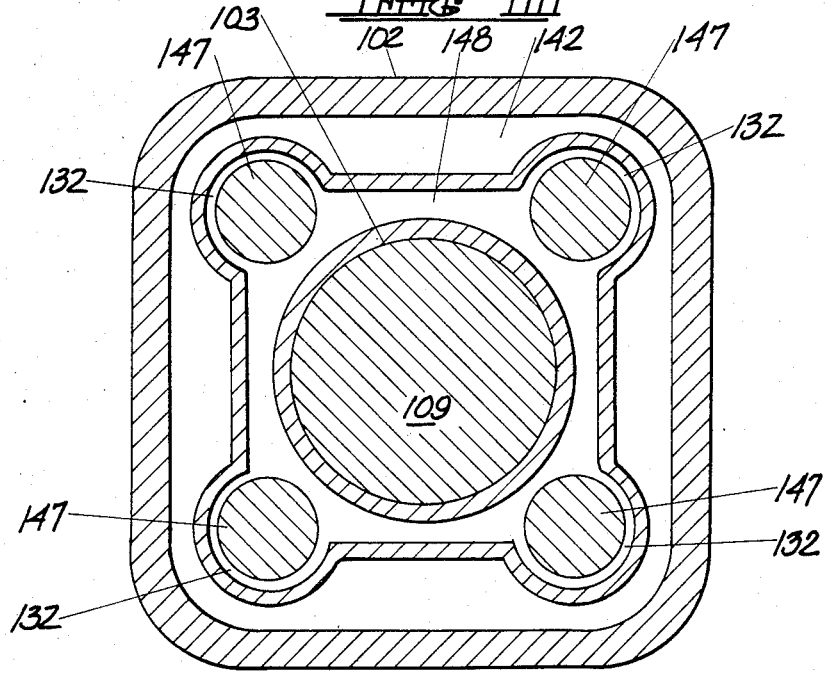
FIG. 12 is a diagrammatic cross-sectional view taken along section line 12—12 of FIG. 7, rotated 45°, illustrating the entire compressor.
Figure 15:
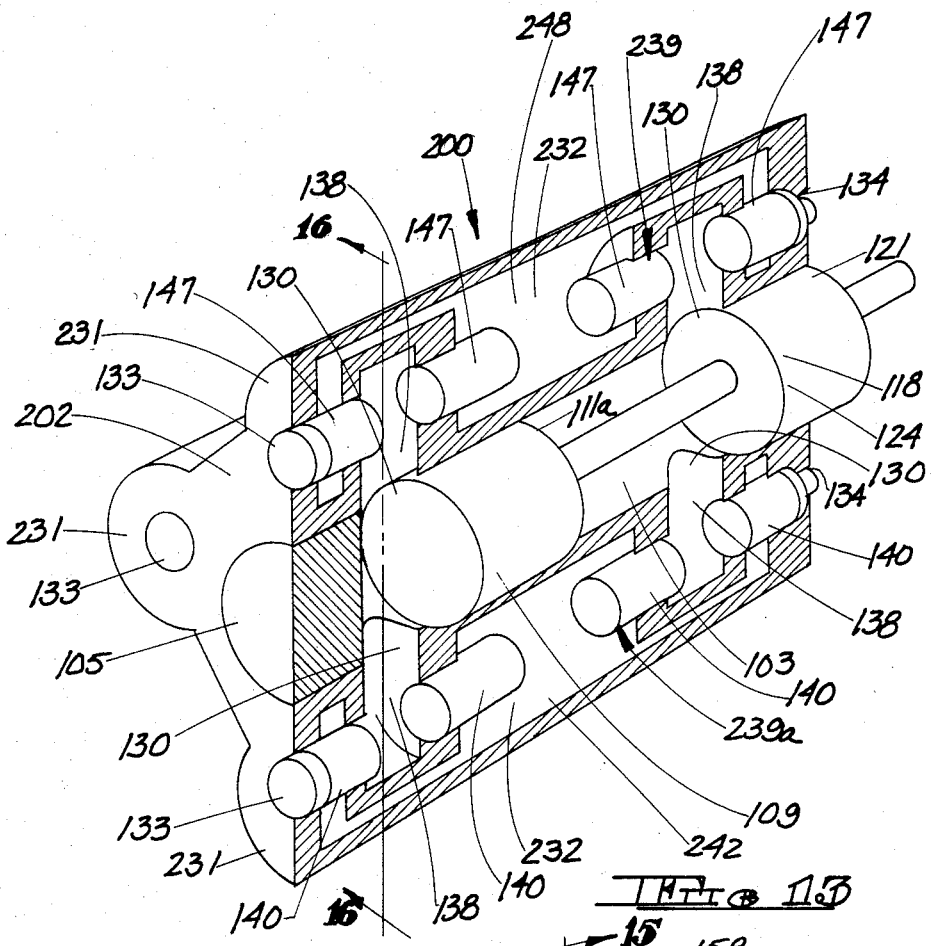
FIG. 15 is a diagrammatic cross-sectional view taken along section line 15—15 of FIG. 14.
Figure 14:
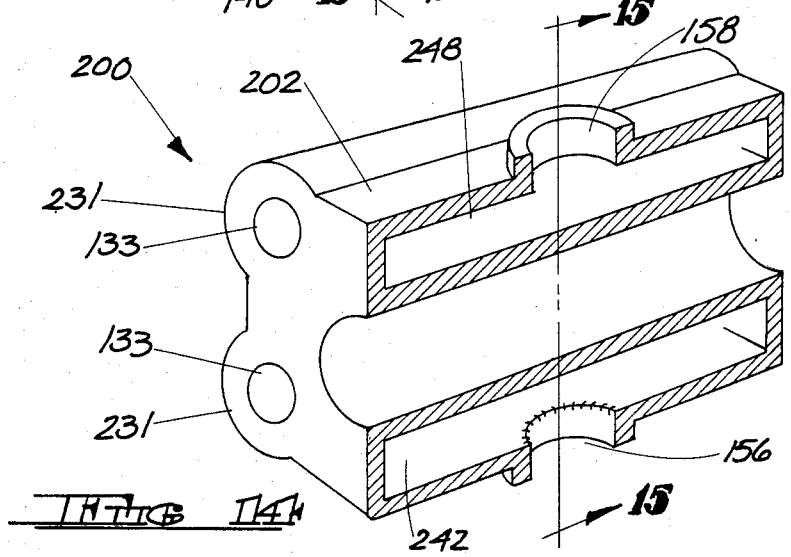
FIG. 14 is a diagrammatic front perspective view, partially in cross-section, of the compressor of FIG. 13 with the piston and cylinder end caps removed for clarity.
Figure 15:
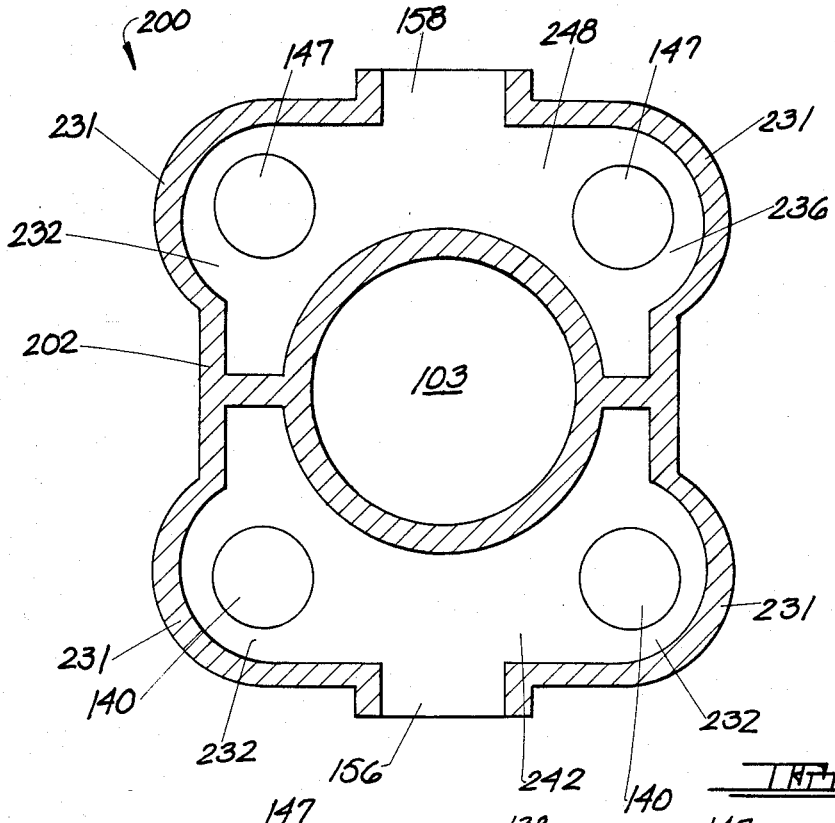

As best shown in FIG. 7 and FIG. 11, each end of cylinder bore 103 is provided with four cylinder wall openings spaced 90° apart extending through the side walls of cylinder 103 and any associated wear sleeve 4. In a preferred embodiment, openings 130 will be positioned beyond the limits of travel of the piston rings during reciprocating movement of the piston as described hereinabove with respect to the embodiment of FIG. 1–FIG. 6. As will be explained in more detail hereinafter, openings 130 permit the fluid to enter and leave cylinder 103 under control of double-acting piston 109.

The outer surface of compressor housing 102 is provided with four generally cylindrical hollow valve housings 131 which are spaced 90° apart and arranged generally longitudinally of the compressor housing. Each valve housing 131 includes a generally cylindrical valve chamber 132 which extends substantially parallel to cylinder bore 103. Each valve chamber 132 includes a gas passageway 138 positioned at both ends which communicate with the adjacent cylinder wall opening 130. The ends of valve chambers 132 may be closed by means of end caps 133 and 134 in a manner similar to that described hereinbefore with respect to end caps 33 and 34. In general either or both of end caps 133 and 134 may be made removable to facilitate removal of the valve assembly as an entire unit.

Positioned within each valve chamber 132 is a valve assembly, shown generally diagrammatically at 139, which is removable horizontally through either end of the valve chamber. In general, each valve assembly unit 139 positioned within the longitudinally extending valve chambers includes a discharge valve 140 and a suction valve 147 positioned on either side, respectively, of gas passageways 138. As illustrated in FIG. 7, discharge valves 140 are positioned within the outermost extremes of valve chambers 132, and operate to permit discharge of high pressure gas during the exhaust or compression stroke of the piston 109. In general, discharge valves 140 may be similar in construction and operation to discharge valves 40 described hereinabove in connection with the embodiment of FIGS. 1–6.

Similarly, suction valves 147 are positioned inwardly of discharge valves 140 and operate to permit intake of low pressure gas during the suction stroke of piston 109. Suction valves 147 may be similar in construction and operation to suction valves 47 described hereinabove in connection with the embodiment of FIG. 1–FIG. 6.

Means in the form of a cylinder-like annular discharge cavity 142 surrounds the cylinder bore 103 and connects the outlet ends of discharge valves 140 to form the exhaust port or discharge outlet 156 of compressor 100.

Similarly, a suction cavity 148 comprises means in the form of a cylinder-like annular passageway or chamber spaced between cylinder bore 103 and discharge cavity 142. Suction cavity 148 connects the inlet openings of suction valves 147 to form suction port 158 located on the upper end of housing 102.

In operation, when piston rod 118 is moved in a direction to cause piston 109 to move toward end cap 105, gas will be drawn inwardly through suction port 158 into suction cavity 148. Suction valves 147 operate to prevent flow of gas through gas passageways 138 located on the left end of compressor 100 as illustrated in FIG. 7, but permit flow of gas from suction cavity 148 through the gas passageways 138 located on the right end of compressor 100 as illustrated in FIG. 7. The gas then passes through the right end cylinder wall openings 130 into cylinder bore 103 adjacent piston working face 111*a*. At the same time, gas entrapped in the portion of cylinder bore 103 adjacent working face 111 of piston 109 is compressed, and passes through gas passageways 130 positioned on the left side of compressor 100 as illustrated in FIG. 7, as well as discharge valves 140 positioned on the left side of the compressor into discharge cavity 142. The higher pressure gas is then discharged from discharge port 156.

When piston rod 118 is reciprocated in the opposite direction to cause piston 109 to move away from end cap 105, low pressure gas is drawn through suction port 158 into suction cavity 148, and through left hand suction valves 147 into the portion of the cylinder bore 103 adjacent working face 111 of piston 109. At the same time, gas entrapped in the portion of cylinder bore 103 adjacent working face 111*a* of piston 109 is compressed and forced through the right end gas passageways 130 and the right end discharge valves 140 into discharge cavity 142, whereupon the gas is discharged from discharge port 156.

It will be observed that this construction of mixed suction and discharge valving having valve chambers positioned longitudinally and substantially parallel to the cylinder bore permits the valves to be located within a common pocket or valve chamber thereby minimizing the amount of machining and additional material which must be removed from the compressor housing casting. In addition, this arrangement minimizes the vertical height of the compressor, to further facilitate side-by-side operation of cooperating compressor units. Finally, since the valve assemblies 139 may be removed as an entire unit or as sub assemblies in a horizontal direction, the need for an additional overhead crane or hoist is completely eliminated in most instances.

Another embodiment of the high pressure gas compressor of the present invention is illustrated in FIG. 13–FIG. 16 where elements similar to those described hereinabove have been similarly designated. In this arrangement, the suction and discharge valving is segregated, rather than being mixed as in the embodiment of FIG. 7–FIG. 12. In particular, this embodiment includes a compressor, shown generally at 200, having a block-like compressor housing 202 supporting four generally cylindrical valve housings 231 spaced 90° apart and extending longitudinally along the compressor housing. Each housing contains a generally cylindrical valve chamber 232 extending substantially parallel to cylinder bore 103 which communicate with the cylinder bore by means of gas passageways 138 leading to cylinder openings 130.

A generally cylindrical piston 109 having working faces 111 and 111*a* is positioned for reciprocating movement within cylinder bore 103 under control of piston rod 118 connected to a suitable reciprocating drive. A suction valve assembly, shown generally at 239, and a discharge valve assembly, shown generally at 239*a*, are positioned in alternate ones of valve chambers 232. As best shown in FIG. 13, suction valve assembly 239 comprises four coaxial suction valves 147, pairs of valves being spaced on either side of gas passageways 138. Similarly, discharge valve assembly 239*a* comprises four coaxially aligned discharge valves 140, arranged in pairs on either side of gas passageways 138. Consequently, valve assemblies 239 and 239*a* comprise only suction or discharge valves, rather than a mixture of suction and discharge valves as in the embodiment of FIG. 7–FIG. 12.

The outlet ends of discharge valves 140 are connected by discharge cavity 242 which comprises a generally semi-cylinder-like passageway or chamber spaced from and surrounding the lower portion of cylinder bore 103. Discharge cavity 242 is connected to discharge port 156 positioned on the lower surface of compressor 200.

Similarly, the inlet ends of suction valves 147 are connected by means of suction cavity 248 comprising a semi-cylinder-like chamber or passageway surrounding and spaced from the upper portion of cylinder bore 103. Suction cavity 248 is connected to the suction port 158 of compressor 200 positioned on the top of the compressor housing.

Figure 16:
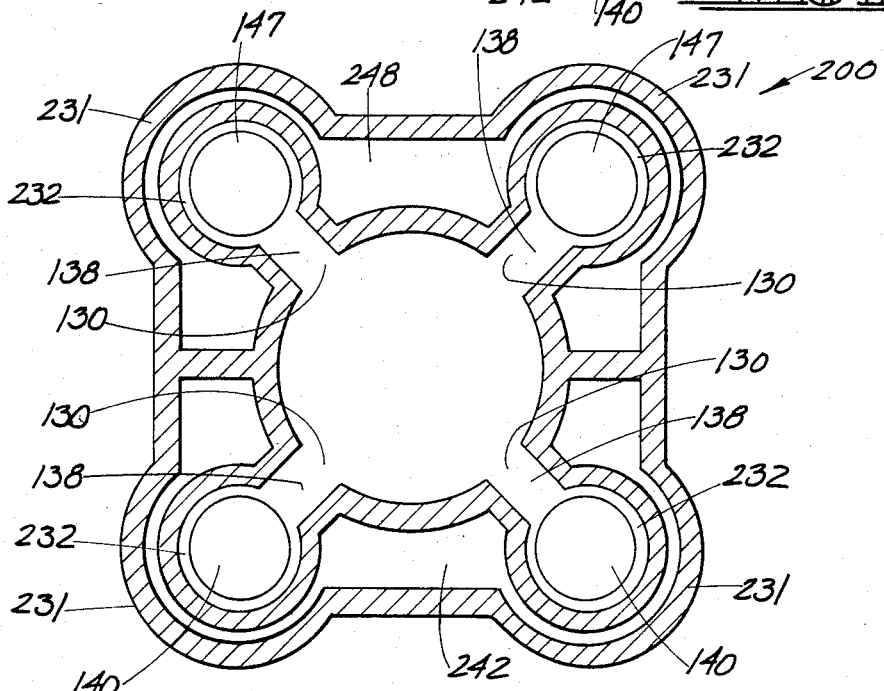
FIG. 16 is a diagrammatic cross sectional view taken along section line 16—16 of FIG. 14.

In operation, when piston 109 is moved in a direction toward cylinder end cap 105, gas is drawn into the portion of the cylinder bore adjacent piston working face 111*a* from suction inlet 158 through the upper suction valves and gas passageways as illustrated in FIG. 16. At the same time, gas entrapped in the portion of the cylinder bore 103 adjacent working face 111 of piston 109 is compressed and exhausted through the lower gas passageways 130 and discharge valves 140 as illustrated in FIG. 16 to discharge port 156.

On the other hand, when piston 109 is moved in a direction away from cylinder end cap 105, low pressure gas is drawn from suction inlet 158 into the portion of cylinder bore 103 adjacent working face 111 of piston 109 through the upper gas passageways 130 and suction valves 147 as illustrated in FIG. 16. At the same time, gas entrapped in the portion of cylinder bore 103 adjacent working face 111*a* of piston 109 is compressed and exhausted through the right-hand gas passageways 138 and discharge valves 140 as illustrated in FIG. 13 to exhaust port 156.

It will be observed that this embodiment of the high pressure gas transmission compressor of the present invention also minimizes the vertical height of the compressor and further facilitates side-by-side operation of cooperating compressor units. Furthermore, since the discharge and suction valves lie within common valve chambers or pockets, machining and removal of housing material is minimized. Finally since the valve assemblies containing the discharge and suction valves may be removed as an entire unit in a horizontal direction, the need for an overhead crane or hoist is eliminated in many instances.

It will be understood that various changes in the details, materials, steps and arrangements of parts, which have been herein described and illustrated in order to explain the nature of the invention, may be made by those skilled in the art within the principal and scope of the invention as expressed in the appended claims. For example, the orientation of compressors 100 and 200 may be inverted to provide for top discharge and bottom suction, as required.

The embodiments of the invention in which an exclusive property or privilege is clamed are as follows:

1. A high-pressure gas transmission compressor for admitting gas at a suction inlet and discharging gas at increased pressure from a discharge outlet comprising:
   - a block-like compressor housing having a substantially horizontal elongated smooth bore cylindrical cylinder extending longitudinally therethrough;
   - a cylindricla piston slidably received for reciprocating movement within said cylinder;
   - a pair of vertically extending spaced valve housings positioned on each side of said cylinder and formed within the compressor housing, each of said valve housings enclosing a vertically oriented hollow elongated valve chamber positioned so that the upper and lower ends of each of said chambers extend above and below, respectively, said cylinder, said valve chambers being parallel to each other such that the center line of said cylinder is perpendicular to and non-intersecting with the center lines of said valve chambers;

spaced openings extending tHrough the side walls of said cylinder;

a gas passageway connecting each of said openings with one of said valve chambers;

discharge valve means positioned within at least one of said valve chambers to permit gs flow from said cylinder to said discharge outlet but prevent gas flow in the opposite direction;

suction valve means positioned within at least one of said valve chambers to permit gas flow from said suction inlet to said cylinder but prevent gas flow in the opposite direction; and means connecting the outlet ends of said discharge valves and the inlet ends of said suction valves to the discharge outlet and suction inlet, respectively, said discharge valve means and said suction valve means comprising a plurality of valves positioned within each of said valve chambers and means connecting said valves to permit their withdrawal as a unit through one end of the valve chamber.

2. The compressor according to claim 1 including an annular piston ring extending circumferentially around said piston to form a sliding seal with said cylinder wall, said spaced openings being positioned longitudinally beyond the limits of travel of said piston ring during reciprocating movement of said piston.

3. The compressor according to-claim 1 wherein said piston is double-acting.

4. The compressor according to claim 1 wherein said gas passageway is substantially centrally located on said valve chamber, said discharge valve means comprising a discharge valve vertically spaced on one side of said gas passage way, said suction valve means comprising a suction valve vertically spaced on the other side of said gas passageway.

5. The compressor according to claim 1 wherein said connecting means joining said discharge valves with said discharge outlet comprises a semi-cylinder like annular discharge cavity spaced from and partially surrounding a portion of said cylinder, and said connecting means joining said suction cavity and said suction valves comprises a semi-cylinder like annular cavity spaced from and partially surrounding the opposite portion of said cylinder.

6. A high pressure gas transmission compressor for admitting gas at a sunction inlet and discharging gas at increased pressure from a discharge outlet comprising:

a block-like compressor housing having a substantially horizontal elongated smooth bore cylindrical cylinder extending longitudinally therethrough;

a cylindrical piston slidably received for reciprocating movement within said cylinder, said piston being double-acting and including an annular piston ring extending circumferentially around said piston to form a sliding seal with said cylinder wall;

a pair of vertically extending spaced valve housings positioned on each side of said cylinder and formed within the compressor housing, each of said valve housings enclosing a vertically oriented hollow elongated valve chamber positioned so that the upper and lower ends of each of said chambers extend above and below, respectively, said cylinder, said valve chambers being parallel to each other such that the center lines of said cylinder is perpendicular to and non-intersecting with the center lines of said valve chambers;

spaced openings positioned beyond the limits of travel of the piston ring during reciprocating movement of the piston extending through the side wall of said cylinder;

a gas passageway centrally located on each valve chamber connecting each of said openings with one of said valve chambers;

discharge valve means comprising a discharge valve spasced on one side of said gas passageway within each of said valve chambers to permit gas flow from said cylinder to said discharge outlet but prevent gas flow in the opposite direction;

suction valve means comprising a suction valve coaxial with said discharge valve and spaced on the other side of said gas passageway within each of said valve chambers to permit gas flow from said suction inlet to said cylinder but prevent gas flow in the opposite direction;

means connecting said suction and discharge valves within each of said chambers to facilitate their removal as a unit through one of the chamber; and means connecting the outlet ends of said discharge valves and the inlet ends of said suction valves to the discharge outlet and suction inlet, respectively, said connecting means joining said discharge valves to said discharge outlet comprising a semi-cylinder like annular discharge cavity spaced from and partially surrounding a portion of said cylinder, said cavity extending longitudinally a distance at least as great as the distance between longitudinally spaced cylinder openings, said connecting means joining said suction cavity and said suction valve comprising a semi-cylinder like annular cavity spaced from and partially surrounding the opposite portion of said cylinder, said suction cavity extending longitudinally a distance at least as great as the distance between longitudinally spaced cylinder openings.

7. A high-pressure gas transmission compressor for admitting gas at a suction inlet and discharging gas at increased pressure from a discharge outlet comprising:

a block-like compressor housing having a substantially horizontal elongated smooth bore cylindrical cylinder extending longitudinally therethrough;

a cylindrical double-acting piston slidably received for reciprocating movement within said cylinder, said piston including an annular piston ring extending circumferentially around said piston to form a sliding seal with said cylinder wall;

a pair of vertically extending spaced valve housings positioned on each side of said cylinder and formed within the compressor housing, each of said valve housings enclosing a vertically oriented hollow elongated valve chamber positioned so that the upper and lower ends of each of said chambers extend above and below, respectively, said cylinder, said valve chambers being parallel to each other such that the center line of said cylinder is perpendicular to and non-intersecting with the center lines of said valve chambers;

spaced openings extending through the side walls of said cylinder, said spaced openings being positioned beyond the limits of travel of said piston ring during reciprocating movement of said piston;

a gas passageway connecting each of said openings with one of said valve chambers, said gas passageway being centrally located on said valve chamber;

discharge valve means positioned within at least one of said valve chambers to permit gas flow from said cylinder to said discharge outlet but prevent gas flow in the opposite direction, said discharge valve means comprising a discharge valve vertically spaced on one side of said gas passageway;

suction valve means positioned within at least one of said valve chambers to permit gas flow from said suction inlet to said cylinder but prevent gas flow in the opposite direction, said suction valve means comprising a suction valve coaxial with said discharge valve and vertically spaced on the other side of said gas passageway;

means connecting the outlet ends of said discharge valves and the inlet ends of said suction valves to the discharge outlet and suction inlet, respectively; and means connecting said suction and discharge valves within each of said chambers to facilitate their removal as a unit through one end of the chamber, said connecting means joining said discharge valves to said discharge outlet comprising a semi-cylinder like annular discharge cavity spaced from and partially surrounding a portion of said cylinder, said cavity extending longitudinally a distance at least as great as the distance between longitudinally spaced cylinder openings, said connecting means joining said suction cavity and said suction valve comprising a semi-cylinder like annular cavity spaced from and partially surrounding the opposite portion of said cylinder, said suction cavity extending longitudinally a distance at least as great as the distance between longitudinally spaced cylinder openings.

* * * * *